United States Patent [19]

Okoshi et al.

[11] Patent Number: 4,532,724

[45] Date of Patent: Aug. 6, 1985

[54] ANTISTATIC FOOTWEAR

[75] Inventors: Koichi Okoshi, Tokyo; Ryuichi Uematsu, Iwatsuki, both of Japan

[73] Assignee: Midori Anzen Industry Co., Ltd., Tokyo, Japan

[21] Appl. No.: 490,776

[22] Filed: May 2, 1983

[51] Int. Cl.[3] ..... A43B 3/16

[52] U.S. Cl. ..... 36/7.1 R; 36/2 R; 36/84

[58] Field of Search ..... 36/7.1 R, 84, 85, 58.5, 36/113, 7.1 A, 2 R, 83, 1.5; 139/425 R

[56] References Cited

U.S. PATENT DOCUMENTS

| | | | |
|---|---|---|---|
| 527,717 | 10/1894 | Pendergast | 36/84 |
| 808,666 | 1/1906 | Linthicum | 36/1.5 |
| 1,003,077 | 9/1911 | Watson | 36/2 R |
| 2,229,575 | 1/1941 | Kaplan | 36/7.1 R |
| 2,230,291 | 2/1941 | Evans | 36/1.5 |
| 2,799,951 | 7/1957 | Rogers | 36/7.1 R |
| 2,824,390 | 2/1958 | Walker | 36/1.5 |
| 2,958,012 | 10/1960 | Melman | 36/7.1 R |
| 3,335,506 | 8/1967 | Pence | 36/7.1 R |
| 3,359,658 | 12/1967 | Price | 36/7.1 R |
| 3,422,550 | 1/1969 | Robinson | 36/7.1 R |
| 3,564,335 | 2/1971 | Siegel | 36/7.1 R |
| 3,678,675 | 7/1972 | Klein | 139/425 R |
| 3,824,714 | 7/1974 | Glassman | 36/7.1 R |
| 3,875,687 | 4/1975 | Henderson | 36/7.1 R |
| 4,019,265 | 4/1977 | Epstein | 36/7.1 R |
| 4,083,124 | 4/1978 | Michalak | 36/7.1 R |
| 4,322,232 | 3/1982 | Beane | 66/194 |

FOREIGN PATENT DOCUMENTS

| | | | |
|---|---|---|---|
| 2502912 | 10/1982 | France | 36/7.1 R |
| 208342 | 1/1940 | Switzerland | 36/2 |
| 261005 | 2/1928 | United Kingdom | 36/2 R |

*Primary Examiner*—Werner H. Schroeder
*Assistant Examiner*—Mary A. Ellis
*Attorney, Agent, or Firm*—Prutzman, Kalb, Chilton & Alix

[57] ABSTRACT

Conductive leg covers for covering the legs of a wearer of antistatic or conductive shoes are connected to the shoes. Thereby footwear is obtained which leaks static electricity safely from a wearer charged therewith, prevents the falling of dust from the cuffs of the trousers worn by the wearer, reduces wearing problems, and is easy to wear.

13 Claims, 2 Drawing Figures

ANTISTATIC FOOTWEAR

BACKGROUND OF THE INVENTION (1) Field of the Invention

This invention relates to footwear for preventing the wearer from being charged with static electricity, and it relates, in particular, to footwear used by people who work in or attend places wherein it is necessary to prevent the occurrence of problems caused by static electricity.

The problems caused by the static electricity can be classified into the following patterns.

1. Problems caused by electrostatic forces:

Faulty products due to the adsorption or repulsion of dust, various germs, etc., wrapping with cloth; clogging during sieving, etc.

Examples of the industries, etc., likely to be affected by these problems: the manufacture of medicines, foodstuffs, etc.; the manufacturing and assembling processes of precision machinery and tools, semiconductors, electronic components, photosensitive materials, etc.; the clean rooms of hospitals or other facilities wherein the air must be kept clean, etc.

2. Problems caused by electric discharges:

Electric shocks, ignition of inflammable materials, breakdown of IC elements, noise in electronic apparatuses, etc.

Examples of the industries, etc., likely to be affected by these problems: oil refining; the production and transportation of gases or other inflammables; tankers; gas stations; the electric power industry; the manufacture of electronic apparatuses, etc.

3. Problems caused by electrostatic fields:

Faulty operation of electronic apparatuses, breakdown of IC elements, formation of charged bodies due to electrostatic induction, etc.

Examples of the industries, etc., likely to be affected by these problems: the manufacture of semiconductors and electronic components; the maintenance of electronic apparatuses and computers, etc.

(2) Prior Art

Antistatic or conductive shoes are usually used in various work places to eliminate the static electricity with which a human body can be charged.

Antistatic shoes, which have an electrical resistance within the range of $1.0\times10^5\Omega$ to $1.0\times10^8\Omega$, fulfill the function of preventing the wearer from becoming charged with electricity due to faulty insulation of a distribution line or the like in the work place, i.e. the function of protecting the wearer from electric shocks, by leaking away the static electricity with which the human body can be charged. On the other hand, conductive shoes having a small electric resistance are used in places free from the danger of electric shocks. An example of such is illustrated in Japanese Industrial Standard JIS T 8103 (1983) entitled Anti-Electrostatic Footwears with/without Safety Toes.

Although enabling the removal of static electricity from the wearer charged therewith, these shoes have the fault that they can not prevent tiny pieces of human skin and dust such as waste fibers from falling onto the floor or into the air from the cuffs of the trousers worn by operators, etc. When overshoes covering the cuffs of the trousers are worn so as to compesate for this fault, the wearing of antistatic or conductive shoes becomes more troublesome because of these additional overshoes. In addition, there is the disadvantage that the antistatic or conductive shoes slip inside the overshoes which is uncomfortable for the wearer while walking. When overshoes alone are worn so as to avoid this discomfort, static electricity could not be eliminated safely, because the antistatic or conductive shoes are not worn.

(3) Brief Description of the Invention

The first object of the present invention is to furnish footwear which enables the safe leakage of static electricity from the wearer even when he is charged therewith, weakens electrostatic forces, prevents dust from being caught by clothes, checks any rise in potential and protects the wearer from electric shocks, in short, footwear which prevents the problems caused by static electricity and which can be used safely in the above industries, etc.

The second object of the present invention is to furnish footwear which has leg covers covering the cuffs of the trousers worn by operators, etc., so as to prevent dust from falling onto the floor or into the air from the cuffs.

The third object of the present invention is to furnish footwear constituted by antistatic or conductive shoes and leg covers connected thereto continuously, which enables the reduction of problems in wearing, compared with the practice in which overshoes are worn in addition to antistatic or conductive shoes, and which are comfortable in wear due to the constitution thereof enabling the elimination the disadvantage that antistatic or conductive shoes slip inside overshoes while the wearer thereof is walking.

The characteristics, principles and details of the present invention will be made more apparent by the following detailed description of the preferred embodiments of the present invention with reference to the attached drawings.

DESCRIPTION OF THE PREFERRED EMBODIMENTS

Figure 1:
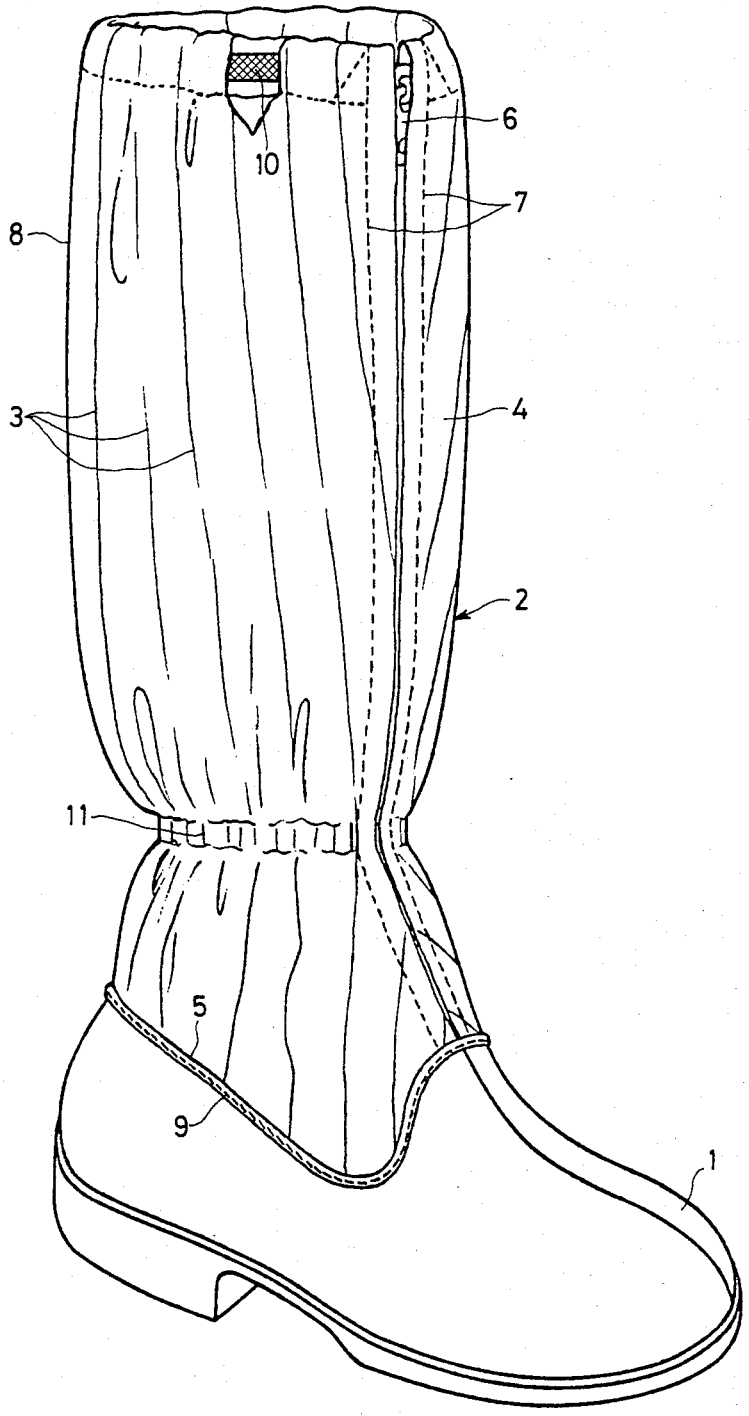
FIG. 1 is a perspective view of antistatic footwear which is one embodiment of the present invention.

The following is the description of the preferred embodiments of the present invention with reference to the drawings. In FIG. 1, numeral 1 denotes an antistatic shoe which has an electrical resistance of not less than $1.0\times10^5\Omega$ and not more than $1.0\times10^8\Omega$. Numeral 2 denotes a leg cover covering the leg of the wearer of the antistatic shoe 1. This cover is prepared by a method wherein the lower edge of cloth 4 threaded vertically with electroconductive fibers 3 is cut out along the top edge 5 of the wear line the antistatic shoe 1, a tubular body 8 thereof is formed so that it can be opened and closed by a zip fastener 6 sewn to the two side edges of the cloth 4, and the lower edge of the tubular body 8 is sewn with a seam 9 to the antistatic shoe 1 along the top edge 5 of the wear line thereof. An acceptable material would be conductive polyvinyl chloride. Numeral 10 denotes an elastic strip inserted through the upper edge of the leg cover 2, the upper edge of the cover 2 is tightened thereby onto the leg of the wearer of the antistatic shoe 1. Numeral 11 denotes another elastic strip sewn to the cloth so that it tightens the ankle part of the leg cover 2.

The function of the antistatic shoes constituted as described above will be explained in the following. When working clothes, etc., become charged with static electricity when an operator or the like has put on the antistatic shoes 1, tucked the part of the working trousers below the knees into the leg covers 2, covered his legs therewith, and stand on the ground or a floor surface grounded electrostatically, a non-uniform electric field is formed between the leg covers 2 threaded with the electroconductive fibers 3 and the body of the operator, ions from the air are generated thereby between the conductive fibers 3 and the body, a conductive channel is formed by corona discharge, and the static electricity leaks away safely through the body of the operator.

By leaking away static electricity, the antistatic shoes 1 fulfill the function of protecting the wearer from electric shocks. In a place where there is no danger of electric shocks, however, conductive shoes fitted with conductive leg covers may be employed in place of the antistatic shoes 1.

Figure 2:
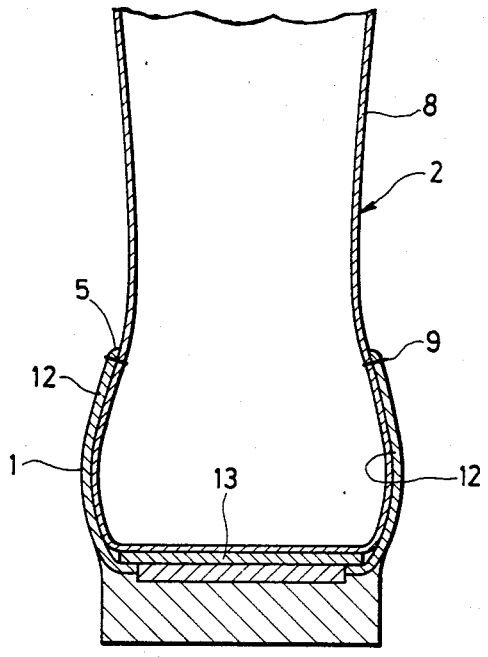
FIG. 2 is a section of antistatic footwear which is another embodiment of the present invention.

In the embodiment described above, the leg cover 2 is connected to the antistatic or conductive shoe 1 by the seam 9 along the lower edge thereof to the shoe along the top edge 5 of the wear line of the shoe. The present invention is not limited to this embodiment, the conductive leg cover 2 can be connected to any appropriate place between the edge 5 of the wear line to the internal sole 13 of the antistatic or conductive shoe 1, for instance, by extending the lower end of the cover via the internal surface of the upper 12 of the shoe so that it touches and is attached to the whole surface or part of the internal sole, as shown in FIG. 2. The lower edge of the leg cover 2 can also be connected removably to the shoe 1 by buttons or other fastenings. This embodiment has the advantage that the leg cover 2 can be removed from the shoe 1 for washing when it is dirty. The leg cover 2 can also have the form of a tubular body having no zip fastener 6 sewn thereto and thus being non-operable. The leg cover 2 may be formed of any material provided that it has electroconductivity.

As described above, the footwear proposed by the present invention is much more suitable as footwear for use in various work places where the footwear is required to leak static electricity safely away from the wearer, preventing the falling of dust from the cuffs of trousers worn by the wearers, is comfortable to wear, and prevents the occurrence of problems due to the static electricity.

What is claimed is:

1. Antistatic footwear comprising, a shoe having a top portion with an upper edge and a sole assembly, said shoe being comprised of material having a predetermined electrical resistance to ground for regulating the discharge of static electricity from the body of the wearer, a leg cover configured to encircle the leg of the wearer below the knee with the wearer's trousers being tucked between said cover and the encircled leg, said leg cover being formed as a tubular body having an upper edge and being made of cloth threaded vertically with conductive fibers, said leg cover having a lower edge portion affixed to said shoe and being comprised of electroconductive material so as to form an electric field between the leg cover and the encircled leg of the wearer and a conductive channel by corona discharge for controlled discharge of static electricity when the leg cover is worn around the leg of a wearer electrically charged with static electricity, and means for maintaining the leg cover about the leg of the wearer, said means comprising an elastic strip inserted through the upper edge of said tubular body.

2. The antistatic footwear according to claim 1 wherein said tubular body has an ankle portion adapted to be disposed adjacent the ankle of a wearer and an elastic strip adapted for tightening the footwear to the ankle of the wearer of the shoes is sewn to the ankle portion of the tubular body.

3. The antistatic footwear according to claim 1, wherein said shoe has a wear line with a top edge and the lower edge of the tubular body is cut out along the top edge of the wear line of the shoe and is sewn to the edge of the wear line of the shoe.

4. The antistatic footwear according to claim 1, wherein the tubular body in formed in a tubular shape by using cloth threaded vertically with conductive fibers and a zip fastener is fitted to the two side edges of the cloth.

5. Antistatic footwear comprising, a shoe having a top portion with a wear line and an upper edge and a sole assembly, said shoe being comprised of material having a predetermined electrical resistance to ground for regulating the discharge of static electricity from the body of the wearer, a leg cover configured to encircle the leg of the wearer below the knee with the wearer's trousers being tucked between said cover and the encircled leg, said leg cover having a lower edge portion and being affixed along said lower edge portion to said shoe between the wear line and sole assembly of said shoe and being comprised of electroconductive material with vertically extending electroconductive fibers so as to form an electric field between the leg cover and the encircled leg of the wearer and a conductive channel by corona discharge for controlled discharge of static electricity when the leg cover is worn around the leg of a wearer electrically charged with static electricity, and means for maintaining the leg cover about the leg of the wearer.

6. The antistatic footwear according to claim 5, wherein the sole assembly of the shoe includes an internal sole and the leg cover is extended so that the lower edge thereof is in contact with at least a part of the internal sole of the shoe via the internal surface of the upper thereof.

7. The antistatic footwear according to claim 5, wherein the lower edge of the leg cover is connected removably to the shoe.

8. The antistatic footwear according to claim 6 wherein the leg cover is extended so that the lower edge portion thereof is in contact with the entire internal surface of the internal sole.

9. The antistatic footwear according to claim 5 wherein said shoe is comprised of material having a relatively high predetermined resistance for controllably leaking away static electricity from the body of the wearer.

10. The antistatic footwear according to claim 9 wherein the electrical resistance of said shoe is within the range of $1.0\times10^5$ ohms to $1.0\times10^8$ ohms.

11. The antistatic footwear according to claim 5 wherein said shoe is comprised of material having a low predetermined resistance.

12. The antistatic footwear according to claim 5 wherein said sole assembly has an internal sole with an upwardly disposed surface for contact with the foot of the wearer and said lower edge of said leg cover is affixed along the circumference of said surface.

13. The antistatic footwear according to claim 5 wherein said sole assembly has an internal sole with an upwardly disposed surface for supporting the foot of the wearer and said lower edge of said leg cover covers said surface.

* * * * *